United States Patent [19]

Berton et al.

[11] 4,331,551

[45] May 25, 1982

[54] METHOD OF REMOVING RUTHENIUM CONTAMINATION FROM RADIOACTIVE EFFLUENTS

[75] Inventors: Yves Berton, Le Puy-Ste Reparade; Pierre Chauvet, Manosque, both of France

[73] Assignee: Commissariat a l'Energie Atomique, Paris, France

[21] Appl. No.: 144,911

[22] Filed: Apr. 29, 1980

[30] Foreign Application Priority Data

May 7, 1979 [FR] France ..... 79 11470

[51] Int. Cl.[3] ..... G21F 9/12

[52] U.S. Cl. ..... 252/631; 210/682; 210/684; 210/717

[58] Field of Search ..... 423/2, 22; 210/682, 210/684, 717

[56] References Cited

U.S. PATENT DOCUMENTS 2,792,412 5/1957 Schmidt et al. ..... 423/22

3,853,980 12/1974 Berton et al. ..... 423/22

*Primary Examiner*—Deborah L. Kyle

*Attorney, Agent, or Firm*—Pearne, Gordon, Sessions, McCoy & Granger

[57] ABSTRACT

A method of removing ruthenium contamination from a radioactive liquid effluent, wherein:

(a) the pH of said effluent is adjusted to a value of less than 5 and copper ions are added thereto, (b) the effluent thus treated is brought into contact with iron to form a copper precipitate which entrains the ruthenium, and (c) the liquid effluent is separated from the sludge formed.

5 Claims, No Drawings

METHOD OF REMOVING RUTHENIUM CONTAMINATION FROM RADIOACTIVE EFFLUENTS

BACKGROUND OF THE INVENTION

This invention relates to a method of removing ruthenium contamination from radioactive effluents, which can be used for crude effluents or for effluents previously subjected to chemical decontamination treatments of the conventional kind.

It is known that radioactive effluents, such as solutions produced by the treatment of irradiated fuels, can be subjected to various chemical decontamination treatments by which the ruthenium can be eliminated, in particular. The majority of these treatments consist of forming, in the effluent which is to be treated, precipitates capable of fixing the ruthenium, for example by adding ferrous ions and copper ions to this effluent and then rendering the medium alkaline to precipitate the corresponding iron and copper compounds.

However, the effluents thus treated still have an excessive ruthenium content, and therefore require additional treatment to bring their residual ruthenium activity down to acceptable levels.

BRIEF SUMMARY OF THE INVENTION

This invention relates precisely to a method of removing ruthenium contamination from liquid radioactive effluents, by means of which, in particular, it is possible to improve the ruthenium decontamination of effluents which have previously been treated by chemical processes of the conventional kind.

The method according to the invention for removing ruthenium contamination from a radioactive liquid effluent is characterised in that it consists in:

(a)—adjusting the pH of said effluent to a value of less than 5 and adding copper ions thereto, (b)—bringing the effluent thus treated into contact with iron to form a copper precipitate which entrains the ruthenium, and (c)—separating the liquid effluent from the sludge formed.

The method according to the invention advantageously makes use of the fact that, by bringing an effluent containing $Cu^{2+}$ ions into contact with iron, there is obtained, by the following reaction:

$$Cu^{2+} + Fe^{o} \rightarrow \downarrow Cu^{o} + Fe^{2+}$$

a copper deposit which entrains the majority of the ruthenium, this copper deposit being accompanied by partial dissolving of the iron in the effluent in the form of ferrous iron.

Moreover, according to the invention, the degree of ruthenium decontamination of the effluent can be further improved by subsequently adjusting the pH of the effluent to a value of more than 8 in order to precipitate the iron which has gone into solution, thus enabling an additional amount of ruthenium to be fixed on the iron hydroxide precipitate.

According to an advantageous feature of the method according to the invention, the quantity of copper ions added to said effluent is from 50 to 100 mg of $Cu^{2+}$ ions per liter of effluent.

According to another feature of the method of the invention, the effluent containing the copper ions is brought into contact with a molar quantity of iron greater than the molar quantity of copper ions added to said effluent.

Advantageously, the quantity of iron used corresponds to about 500 mg of iron per liter of effluent.

According to the invention, the step of bringing the effluent containing copper ions into contact with iron can be carried out in the following two ways:

—either percolating this effluent through a column containing iron, for example in the form of chips, wool or shot, —or by agitating the effluent with powdered iron in a conventional contacter.

The method according to the invention has the particular advantage that it results in a satisfactory level of decontamination and also avoids the formation of large volumes of precipitates and sludges which then have to be stored.

The invention will be more readily understood from the following example, which is given only as an illustration and is in no way restrictive.

In this example, a radioactive effluent obtained from a plant for reprocessing irradiated nuclear fuels, which has previously been chemically treated, is treated according to the method of the invention.

During this preliminary chemical treatment, copper ions and ferrous ions in the form of an aqueous solution of the corresponding sulphate are added to the effluent, which originally had a radiochemical ruthenium 106 activity of 45,000 microcuries per $m^3$, and then soda is added to bring the pH of the effluent to a value of about 8.5, thus enabling ruthenium-entraining precipitates to be formed in this effluent. After coagulation and filtration of the precipitates, the effluent had a ruthenium 106 activity of 3,180 microcuries per $m^3$ and had the following characteristics:

| | | |
|---|---|---|
| Chemical: | | |
| pH | | 7.7 |
| redox potential/ECS | mV | +294 |
| dry extract | g/l | 22 |
| $PO_4^{3-}$ | mg/l | 70 |
| Radiochemical: | | |
| in $1.10^{-6}$ Ci/$m^3$ | | |
| $^{90}Sr$ | | 770 |
| $^{103}Ru$ | | 50 |
| $^{106}Ru$ | | 3,180 |
| $^{125}Sb$ | | 900 |
| $^{134}Cs$ | | 3,450 |
| $^{137}Cs$ | | 15,750 |

After preliminary treatment, a copper sulphate solution is added to the effluent so as to introduce about 100 mg of copper ions per liter of effluent. The pH of the effluent is first adjusted to a value of 3 by adding nitric acid so as to avoid the precipitation of the copper ions in the form of copper hydroxide.

After the pH has been stabilised, the effluent is brought into contact with powdered iron, the quantity of iron used being 500 mg per liter of effluent, by subjecting the mixture to agitation for some minutes in a conventional contacter, thus producing, according to the following reaction plan:

$$Cu^{2+} + Fe^{o} \rightarrow \downarrow Cu^{o} + Fe^{2+}$$

a copper deposit and partial dissolving of the iron in the ferrous state.

Then an amount of soda sufficient to bring the pH to a value substantially equal to 8.5 is added to the effluent, resulting in precipitation of the iron which has gone into solution, and providing additional ruthenium decontamination, as the ruthenium is fixed on the iron precipitate thus formed. Finally, the liquid effluent is separated from the resulting sludge by decanting.

At the end of this treatment, the volume of sludge formed represents 1.5% of the volume of the effluent treated. The ruthenium decontamination level FD of the effluent, which corresponds to the ratio between the ruthenium activities of the effluent before and after the decontamination treatment, is of the order of 8.

Similar experiments conducted on similar effluents, varying the initial pH of the effluent between 2 and 3 and the quantity of copper ions added between 50 and 100 mg per liter of effluent, have shown that a ruthenium FD of between 3 and 10 was obtained. The volume of the sludges formed was between 1 and 2% of the volume of the effluent treated.

It will thus be appreciated that the method of the invention results in a substantial improvement of the level of ruthenium decontamination of an effluent which has been chemically pretreated.

The invention is not limited to the embodiments described and represented hereinbefore and various modifications can be made thereto without passing beyond the scope of the invention.

We claim:

1. A method of removing ruthenium contamination from a radioactive liquid effluent, wherein:

(a) the pH of said effluent is adjusted to a value of less than 5 and copper ions are added thereto, (b) the effluent thus treated is brought into contact with iron to precipitate copper which entrains the ruthenium, and (c) liquid effluent is separated from the sludge formed.

2. A methods according to claim 1, wherein, after the liquid effluent has been brought into contact with the iron, the pH is adjusted to a value of more than 8.

3. A method according to claim 1, wherein the quantity of copper ions added to said effluent is 50 to 100 mg of $Cu^{2+}$ ions per liter of effluent.

4. A method according to claim 1, wherein the effluent containing the copper ions is brought into contact with a molar quantity of iron which is greater than the molar quantity of copper ions added to said effluent.

5. A method according to claim 4, wherein the effluent is brought into contact with a quantity of iron corresponding to about 500 mg of iron per liter of effluent.

* * * * *